US007478899B2

(12) United States Patent
Moynihan et al.

(10) Patent No.: US 7,478,899 B2
(45) Date of Patent: Jan. 20, 2009

(54) PIEZOELECTRIC INK JET MODULE WITH SEAL

(75) Inventors: Edward R. Moynihan, Plainfield, NH (US); Paul A. Hoisington, Norwich, VT (US); Yong Zhou, Hanover, NH (US); Amy L. Brady, Plainfield, NH (US); Robert G. Palifka, Orford, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 278 days.

(21) Appl. No.: 11/336,423

(22) Filed: Jan. 20, 2006

(65) Prior Publication Data

US 2006/0187270 A1 Aug. 24, 2006

Related U.S. Application Data

(63) Continuation of application No. 10/879,689, filed on Jun. 28, 2004, now Pat. No. 7,011,396, which is a continuation of application No. 09/412,827, filed on Oct. 5, 1999, now Pat. No. 6,755,511.

(51) Int. Cl.
*B41J 2/045* (2006.01)

(52) U.S. Cl. ..... 347/68; 347/50

(58) Field of Classification Search ..... 347/40, 347/49–50, 68

See application file for complete search history.

(56) References Cited

U.S. PATENT DOCUMENTS

| | | | |
|---|---|---|---|
| 3,946,398 | A | 3/1976 | Kyser et al. |
| 4,189,734 | A | 2/1980 | Kyser et al. |
| 4,216,483 | A | 8/1980 | Kyser et al. |
| 4,339,763 | A | 7/1982 | Kyser et al. |
| 4,516,140 | A | 5/1985 | Durkee et al. |
| 4,584,590 | A | 4/1986 | Fischbeck et al. |
| 4,695,854 | A | 9/1987 | Cruz-Uribe |

(Continued)

FOREIGN PATENT DOCUMENTS

| | | | |
|---|---|---|---|
| EP | 0 486 256 | A2 | 11/1991 |
| EP | 0 667 239 | A2 | 8/1995 |
| EP | 0 719 642 | A2 | 12/1996 |
| EP | 0 839 655 | A2 | 5/1998 |
| EP | 0 855 273 | A2 | 7/1998 |
| EP | 0 916 497 | A2 | 5/1999 |

OTHER PUBLICATIONS

International Search Report
Canadian foreign Office Action dated Jun. 22, 2006.

*Primary Examiner*—Thinh H Nguyen
(74) *Attorney, Agent, or Firm*—Fish & Richardson P.C.

(57) ABSTRACT

A piezoelectric ink jet head that includes a polymer film, for example a flex print, located between the piezoelectric element and the reservoirs in the jet body. The film provides an efficient seal for the reservoirs and also positions the electrodes on the side of the piezoelectric element in which motion is effected, which can reduce the magnitude of the drive voltage. This location of the compliant flex print material also can enhance electrical and mechanical isolation between reservoirs, which improves jetting accuracy. The compliance of the polymer also reduces strain on the ink jet head.

18 Claims, 7 Drawing Sheets

U.S. PATENT DOCUMENTS 4,891,654 A 1/1990 Hoisington et al.
5,581,288 A 12/1996 Shmiu et al.
5,640,184 A 6/1997 Moynihan et al.
5,657,063 A 8/1997 Takahashi
5,755,909 A 5/1998 Gailus
5,793,394 A 8/1998 Kato
5,883,651 A 3/1999 Thiel et al.
5,946,012 A 8/1999 Courian et al.
6,755,511 B1 * 6/2004 Moynihan et al. ..... 347/68

* cited by examiner

PIEZOELECTRIC INK JET MODULE WITH SEAL

CROSS-REFERENCE TO RELATED APPLICATIONS

This application is a continuation application of and claims priority under 35 U.S.C. §120 to U.S. application Ser. No. 10/879,689, filed on Jun. 28, 2004 now U.S. Pat. No. 7,011,396, which is a continuation application of U.S. application Ser. No. 09/412,827, filed Oct. 5, 1999, which is now issued as U.S. Pat. No. 6,755,511.

BACKGROUND OF THE INVENTION

This invention relates to piezoelectric ink jet modules.

A piezoelectric ink jet module includes a module body, a piezoelectric element, and an electrical connection element for driving the piezoelectric element. The module body, usually carbon or ceramic, is typically a thin, rectangular member into the surfaces of which are machined a series of ink reservoirs that serve as pumping chambers for ink. The piezoelectric element is disposed over the surface of the jet body to cover the pumping chambers and position the piezoelectric material in a manner to pressurize the ink in the pumping chambers to effect jetting.

In a typical shear mode piezoelectric ink jet module, a single, monolithic piezoelectric element covers the pumping chambers to provide not only the ink pressurizing function but also to seal the pumping chambers against ink leakage. The electrical connection is typically made by a flex print positioned over the exterior surface of the piezoelectric element and provided with electrical contacts at locations corresponding to the locations of the pumping chambers. An example of a piezoelectric shear mode ink jet head is described in U.S. Pat. No. 5,640,184, the entire contents of which is incorporated herein by reference.

In one known ink jet module, available from Brother, a resin diaphragm is provided next to each of the pumping chambers. The central region of each diaphragm is pumped by a piezoelectric feature. Electrodes are embedded in the piezoelectric material.

SUMMARY OF THE INVENTION

This invention relates to a piezoelectric ink jet head that includes a polymer, preferably a flex print, located between the piezoelectric element and the pumping chambers in the jet body. The polymer seals the pumping chambers and also positions the electrodes on the side of the piezoelectric element in which motion is effected, which can reduce the magnitude of the drive voltage required for operation. The compliant flex print material also can provide electrical, mechanical, and fluidic pressure isolation between pumping chambers, which improves jetting accuracy.

Thus, in one aspect, the invention features a piezoelectric element that is positioned to subject the ink within an ink reservoir to jetting pressure. A flexible material carries electrical contacts arranged for activation of said piezoelectric element and is positioned between the reservoir and the piezoelectric element in a manner to seal the reservoir.

Implementations of the invention may include one or more of the following features. The material may be a polymer. The ink reservoir may be defined by a multi-element module body. An ink fill flow path leading to the reservoir may be sealed by the polymer. The polymer may include an area that is not supported. The piezoelectric element may be sized to cover the reservoir without covering the ink fill flow path. The module may include a series of reservoirs all covered by a single piezoelectric element, or in other examples by separate respective piezoelectric elements. The module may be a shear mode piezoelectric module. The piezoelectric element may be a monolithic piezoelectric member.

In other general aspects of the invention, the flexible material over the flow path contains an area that is not supported; the piezoelectric element spans the ink reservoir and is positioned to subject the ink within the reservoir to jetting pressure; and electrical contacts are located only on a side of the piezoelectric element adjacent to the ink reservoir. In some implementations, the contacts may be thinner than 25 microns, preferably thinner than 10 microns.

Other features and advantages will become apparent from the following description and from the claims.

DESCRIPTION

We first briefly describe the drawings.

FIG. 4A is a graph of the field lines in a piezo electric element, while

Figure 1:
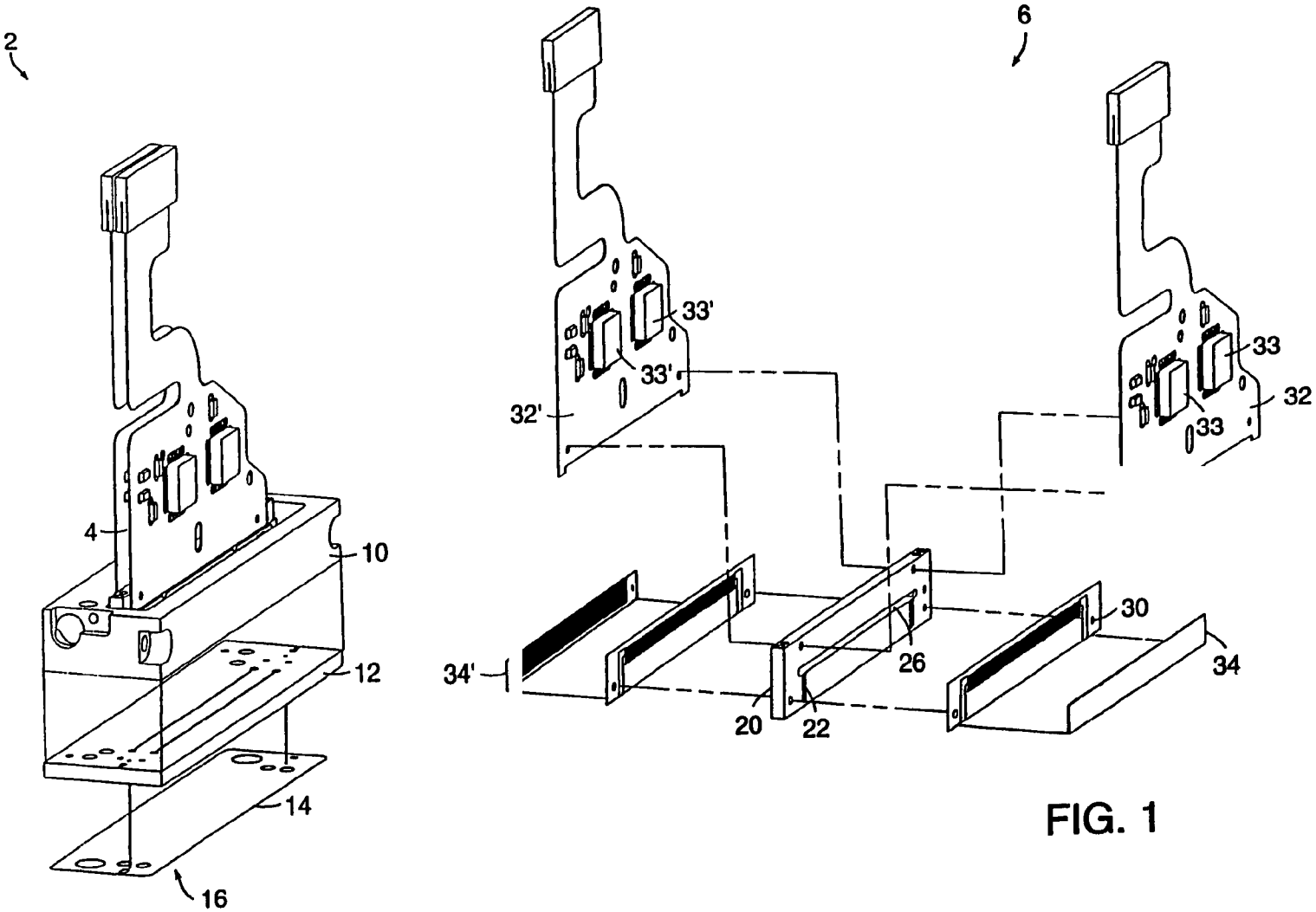
FIG. 1 is an exploded view of a shear mode piezoelectric ink jet print head.

Referring to FIG. 1, a piezoelectric ink jet head 2 includes multiple modules 4, 6 which are assembled into a collar element 10 to which is attached a manifold plate 12, and an orifice plate 14. Ink is introduced through the collar 10 to the jet modules which are actuated to jet ink from the orifices 16 on the orifice plate 14. An exemplary ink jet head is described in U.S. Pat. No. 5,640,184, incorporated supra, and is available as Model CCP-256 (Spectra, Inc., Hanover, N.H.).

Each of the ink jet modules 4, 6 includes a body 20, which is formed of a thin rectangular block of a material such as sintered carbon or ceramic. Into both sides of the body are machined a series of wells 22 which form ink pumping chambers. The ink is introduced through an ink fill passage 26 which is also machined into the body.

The opposing surfaces of the body are covered with flexible polymer films 30, 30' that include a series of electrical contacts arranged to be positioned over the pumping chambers in the body. The electrical contacts are connected to leads, which, in turn, can be connected to a flex print 32, 32' including driver integrated circuit 33, 33'. The films 30, 30' may be flex prints (Kapton) available from Advanced Circuit Systems located in Franklin, N.H. Each flex print film is sealed to the body 20 by a thin layer of epoxy. The epoxy layer is thin enough to fill in the surface roughness of the jet body so as to provide a mechanical bond, but also thin enough so that only a small amount of epoxy is squeezed from the bond lines into the pumping chambers.

Each of the piezoelectric elements 34, 34', which may be a single monolithic PZT member, is positioned over the flex print 30, 30'. Each of the piezoelectric elements 34, 34' have electrodes that are formed by chemically etching away conductive metal that has been vacuum vapor deposited onto the surface of the piezoelectric element. The electrodes on the piezoelectric element are at locations corresponding to the pumping chambers. The electrodes on the piezoelectric element electrically engage the corresponding contacts on the flex print 30, 30'. As a result, electrical contact is made to each of the piezoelectric elements on the side of the element in which actuation is effected. The piezoelectric elements are fixed to the flex prints by thin layers of epoxy. The epoxy thickness is sufficient to fill in the surface roughness of the piezo electric element so as to provide a mechanical bond, but also thin enough so that it does not act as an insulator between the electrodes on the piezoelectric element and the electrodes on the flex print. To achieve good bonds, the electrode metallization on the flex print should be thin. It should be less than 25 microns, and less than 10 microns is preferred.

Figure 2:
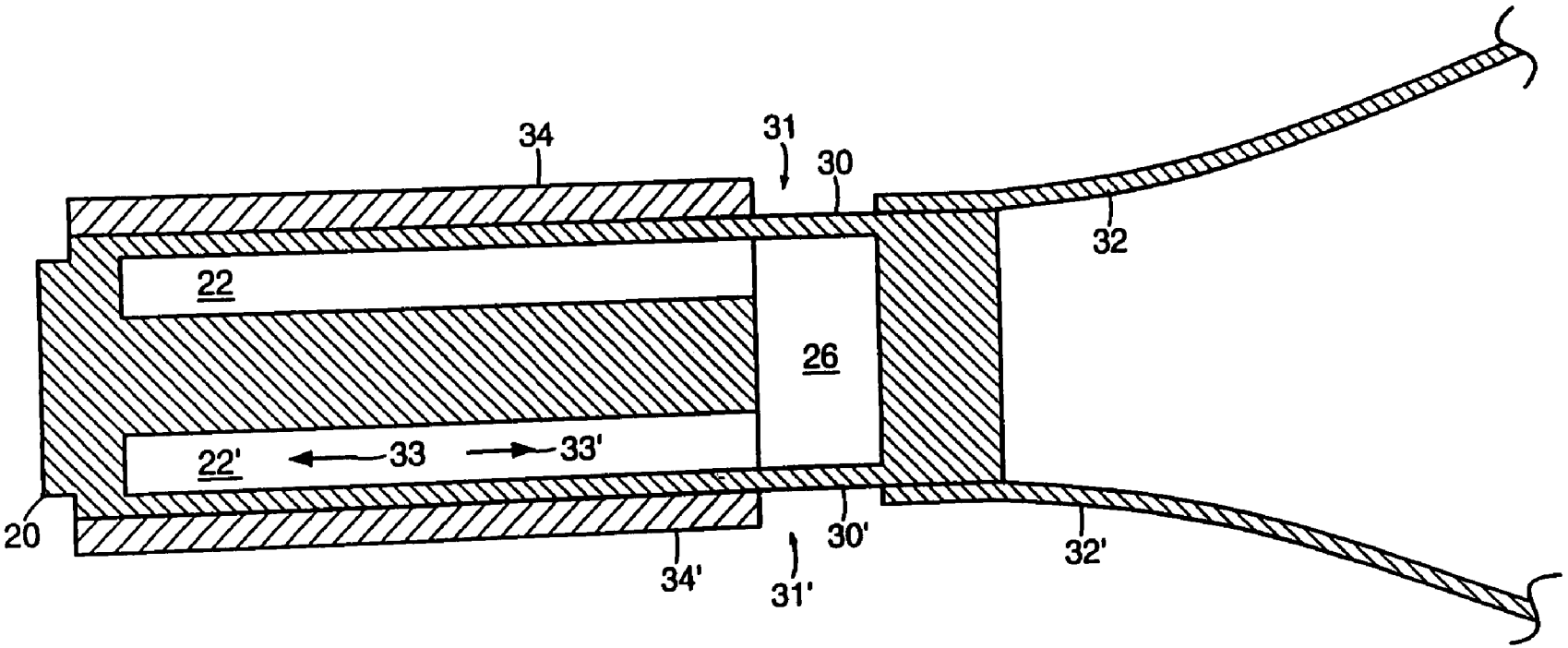
FIG. 2 is a cross-sectional side view through an ink jet module.

Referring to FIG. 2, the piezoelectric elements 34, 34' are sized to cover only the portion of the body that includes the machined ink pumping chambers 22. The portion of the body that includes the ink fill passage 26 is not covered by the piezoelectric element. Thus the overall size of the piezoelectric element is reduced. Reducing the size of the piezoelectric element reduces cost, and also reduces electrical capacitance of the jet, which reduces jet electrical drive power requirements.

The flex prints provide chemical isolation between the ink and the piezoelectric element and its electrodes, providing more flexibility in ink design. Inks that are corrosive to metal electrodes and inks that may be adversely affected by exposure to electrical voltages such as water based inks can be used.

The flex prints also provide electrical isolation between the jet body and the ink, on one hand, and the piezoelectric element and its electrodes on the other hand. This allows simpler designs for jet drive circuitry when the jet body or the ink in the pumping chamber is conductive. In normal use, an operator may come into contact with the orifice plate, which may be in electrical contact with the ink and the jet body. With the electrical isolation provided by the flex print, the drive circuit does not have to accommodate the instance where an operator comes in contact with an element of the drive circuit.

The ink fill passage 26 is sealed by a portion 31, 31' of the flex print, which is attached to the exterior portion of the module body. The flex print forms a non-rigid cover over (and seals) the ink fill passage and approximates a free surface of the fluid exposed to atmosphere. Covering the ink fill passage with a non-rigid flexible surface reduces the crosstalk between jets.

Crosstalk is unwanted interaction between jets. The firing of one or more jets may adversely affect the performance of other jets by altering jet velocities or the drop volumes jetted. This can occur when unwanted energy is transmitted between jets. The effect of providing an ink fill passage with the equivalent of a free surface is that more energy is reflected back into the pumping chamber at the fill end of a pumping chamber, and less energy enters the ink fill passage where it could affect the performance of neighboring jets.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave, to be launched. This negative pressure starts in the pumping chamber and travels toward both ends of the pumping chamber (towards the orifice and towards the ink fill passage as suggested by arrows 33, 33'). When the negative wave reaches the end of the pumping chamber and encounters the large area of the ink fill passage (which communicates with an approximated free surface), the negative wave is reflected back into the pumping chamber as a positive wave, travelling towards the orifice. The returning of the piezoelectric element to its original position also creates a positive wave. The timing of the deactuation of the piezoelectric element is such that its positive wave and the reflected positive wave are additive when they reach the orifice. This is discussed in U.S. Pat. No. 4,891,654, the entire content of which is incorporated herein by reference.

Reflecting energy back into the pumping chamber increases the pressure at the orifice for a given applied voltage, and reduces the amount of energy transmitted into the fill area which could-adversely affect other jets as crosstalk.

The compliance of the flex print over the fill area also reduces crosstalk between jets by reducing the amplitude of pressure pulses that enter the ink fill area from firing jets. Compliance of a metal layer in another context is discussed in U.S. Pat. No. 4,891,654.

Figure 3:
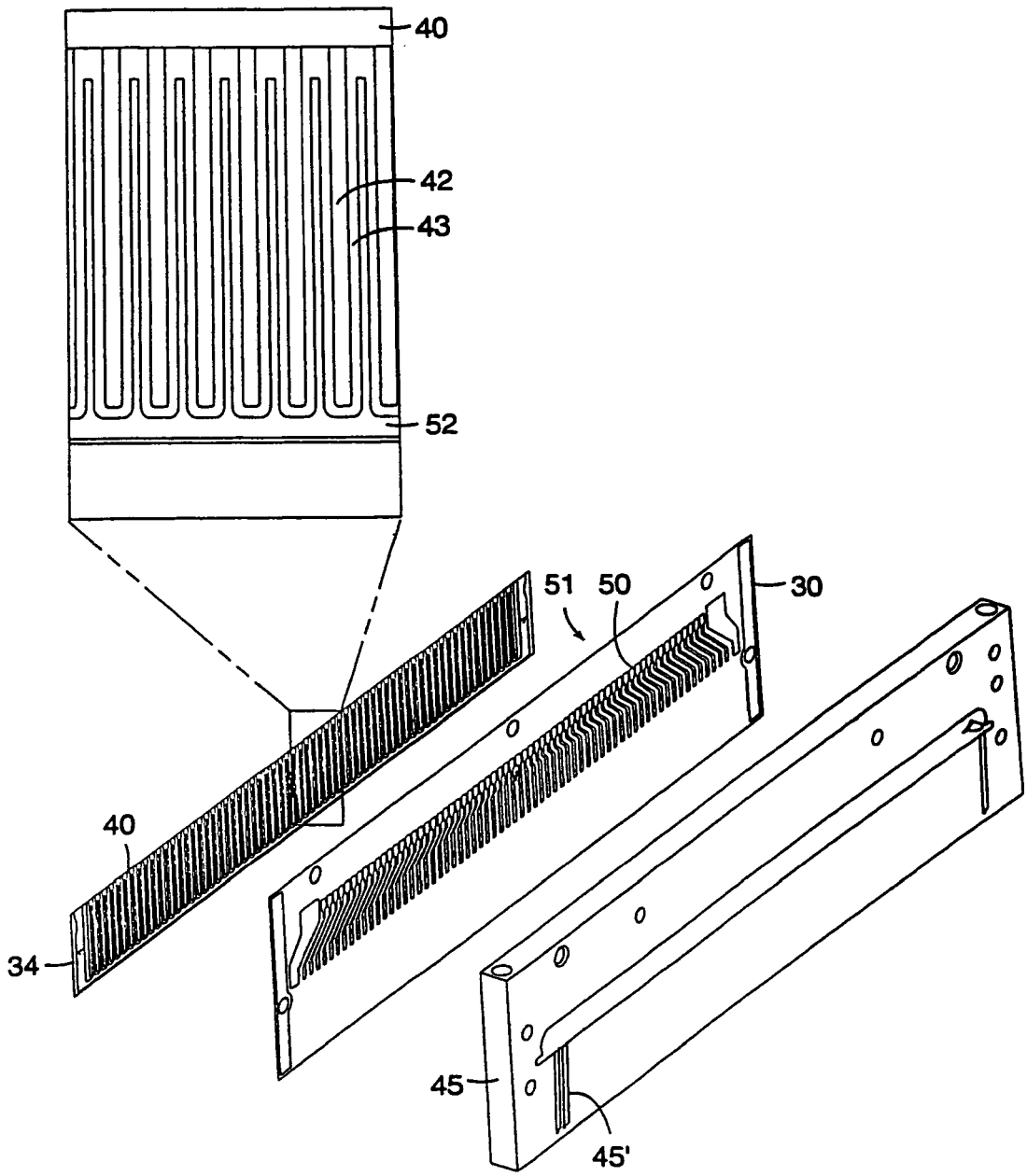
FIG. 3 is a perspective view of an ink jet module illustrating the location of electrodes relative to the pumping chamber and piezoelectric element.

Referring to FIG. 3, the electrode pattern 50 on the flex print 30 relative to the pumping chamber and piezoelectric element is illustrated. The piezoelectric element has electrodes 40 on the side of the piezoelectric element 34 that comes into contact with the flex print. Each electrode 40 is placed and sized to correspond to a pumping chamber 45 in the jet body. Each electrode 40 has an elongated region 42, having a length and width generally corresponding to that of the pumping chamber, but shorter and narrower such that a gap 43 exists between the perimeter of electrode 40 and the sides and end of the pumping chamber. These electrode regions 42, which are centered on the pumping chambers, are the drive electrodes. A comb-shaped second electrode 52 on the piezoelectric element generally corresponds to the area outside the pumping chamber. This electrode 52 is the common (ground) electrode.

The flex print has electrodes 50 on the side 51 of the flex print that comes into contact with the piezoelectric element. The flex print electrodes and the piezoelectric element electrodes overlap sufficiently for good electrical contact and easy alignment of the flex print and the piezoelectric element. The flex print electrodes extend beyond the piezoelectric element (in the vertical direction in FIG. 3) to allow for a soldered connection to the flex print 32 that contains the driving circuitry. It is not necessary to have two flex prints 30, 32. A single flex print can be used.

Figure 4A:
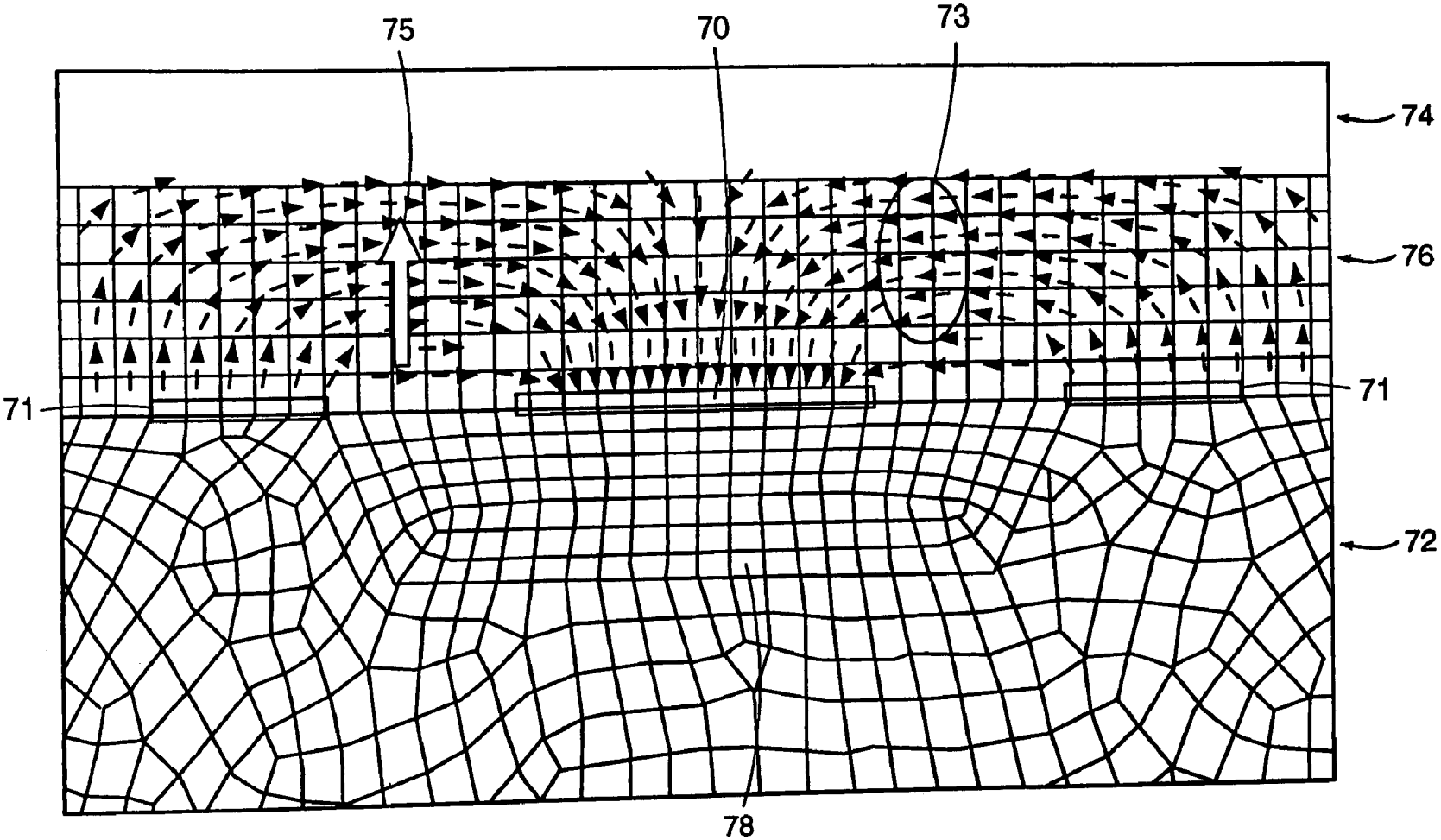
Figure 4B:
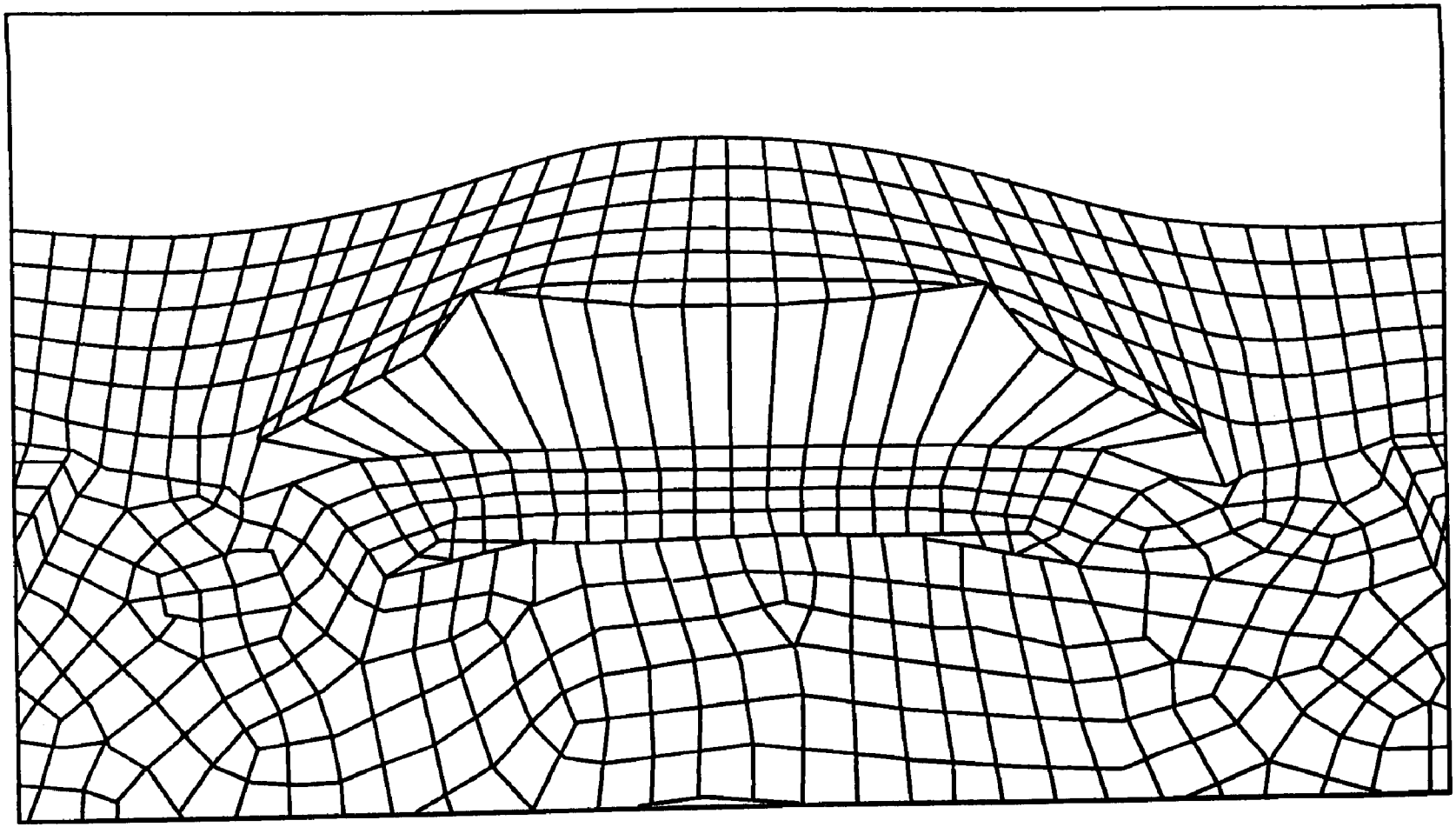
FIG. 4B illustrates element displacement when a driving voltage is applied.

Referring to FIGS. 4A and 4B, a graphical representation of the field lines in a piezoelectric element and the resulting displacement of the piezoelectric element are shown for a single jet. FIG. 4A indicates theoretical electric field lines in the piezoelectric element, and FIG. 4B is an exaggeration of the displacement of the piezoelectric element during actuation for illustration purposes. The actual displacement of the piezoelectric element is approximately $1/10{,}000$ the thickness of the piezoelectric element (1 millionth of an inch). In FIG. 4A, the piezoelectric element is shown with electrodes 70, 71 on the lower surface next to the jet body 72, and air 74 above the piezoelectric element 76. For simplicity, the kapton flex print between the piezoelectric element and jet body is not shown in this view. The drive electrodes 70 are centered on the pumping chambers 78, and the ground electrode is located just outside the pumping chambers. Application of a drive voltage to the drive electrode results in electric field lines 73 as shown in FIG. 4A. The piezoelectric element has a poling field 75 that is substantially uniform and perpendicular to the surface containing the electrodes. When the electric field is applied perpendicularly to the poling field, the piezoelectric element moves in shear mode. When the electric field is applied parallel to the poling field, the piezoelectric element moves in extension mode. In this configuration with ground and drive electrodes on the side of the piezoelectric element that is next to the pumping chambers, for a given applied voltage, the displacement of the surface of the piezoelectric element adjacent to the pumping chamber can be substantially greater than if the electrodes were on the opposite surface of the piezoelectric element.

The bulk of the displacement is due to the shear mode effect, but in this configuration, parasitic extension mode works to increase the displacement. In the piezoelectric element, in the material between the common and the drive electrodes, the electric field lines are substantially perpendicular to the poling field, resulting in displacement due to shear mode. In the material close to the electrodes, the electric field lines have a larger component that is parallel to the poling field, resulting in parasitic extension mode displacement. In the area of the common electrodes, the piezoelectric material extends in a direction away from the pumping chamber. In the area of the drive electrode, the component of the electric field that is parallel to the poling field is in the opposite direction. This results in compression of the piezoelectric material in the area of the drive electrode. This area around the drive electrode is smaller than the area between the common electrodes. This increases the total displacement of the surface of the piezoelectric element that is next to the pumping chamber.

Overall, more displacement may be achieved from a given drive voltage if the electrodes are on the pumping chamber side of the piezoelectric element, rather than on the opposite side of the piezoelectric element. In embodiments, this improvement may be achieved without incurring the expense of placing electrodes on both sides of the piezoelectric element.

Figure 5A:
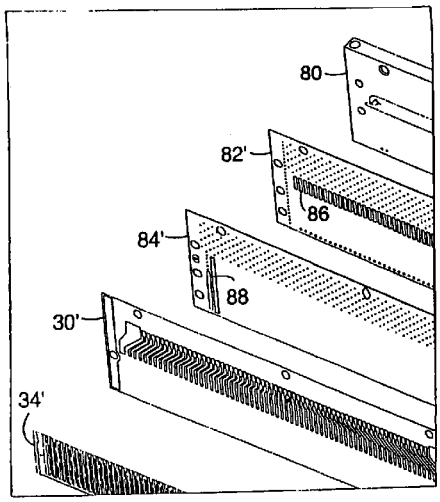
FIG. 5 is an exploded view of another embodiment of an ink jet module.
Figure 5:
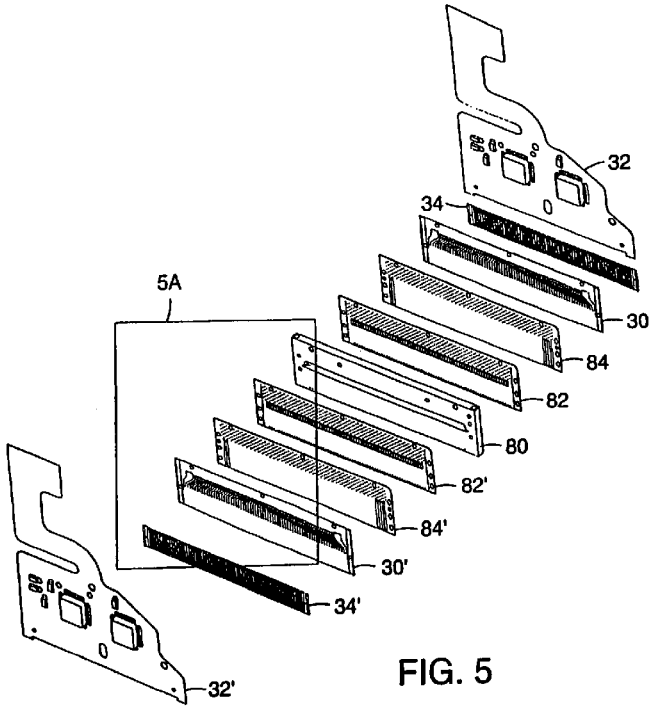

Referring to FIG. 5, another embodiment of a jet module is shown. In this embodiment, the jet body is comprised of multiple parts. The frame of the jet body 80 is sintered carbon and contains an ink fill passage. Attached to the jet body on each side are stiffening plates 82, 82', which are thin metal plates designed to stiffen the assembly. Attached to the stiffening plates are cavity plates 84, 84', which are thin metal plates into which pumping chambers have been chemically milled. Attached to the cavity plates are the flex prints 30, 30', and to the flex prints are attached the piezoelectric elements 34, 34'. All these elements are bonded together with epoxy. The flex prints that contain the drive circuitry 32, 32', are attached by a soldering process.

Describing the embodiment shown in FIG. 5 in more detail, the jet body is machined from sintered carbon approximately 0.12 inches thick. The stiffening plates are chemically milled from 0.007 inch thick kovar metal, with a fill opening 86 per jet that is 0.030 inches by 0.125 inches located over the ink fill passage. The cavity plates are chemically milled from 0.006 inch thick kovar metal. The pumping chamber openings 88 in the cavity plate are 0.033 inches wide and 0.490 inches long. The flex print, attached to the piezoelectric element is made from 0.001 inch Kapton, available from The Dupont Company. The piezoelectric element is 0.010 inch thick and 0.3875 inches by 2.999 inches. The drive electrodes on the piezoelectric element are 0.016 inches wide and 0.352 inches long. The separation of the drive electrode from the common electrode is approximately 0.010 inches. The above elements are bonded together with epoxy. The epoxy bond lines between the flex print and the piezoelectric element have a thickness in the range of 0 to 15 microns. In areas were electrical connection must be made between the flex print and the piezoelectric element, the thickness of the epoxy must be zero at least in some places, and the thickness of the epoxy in other places will depend on surface variations of the flex print and the piezoelectric element. The drive circuitry flex print 32 is electrically connected to the flex print 30 attached to the piezoelectric element via a soldering process.

Figure 6:
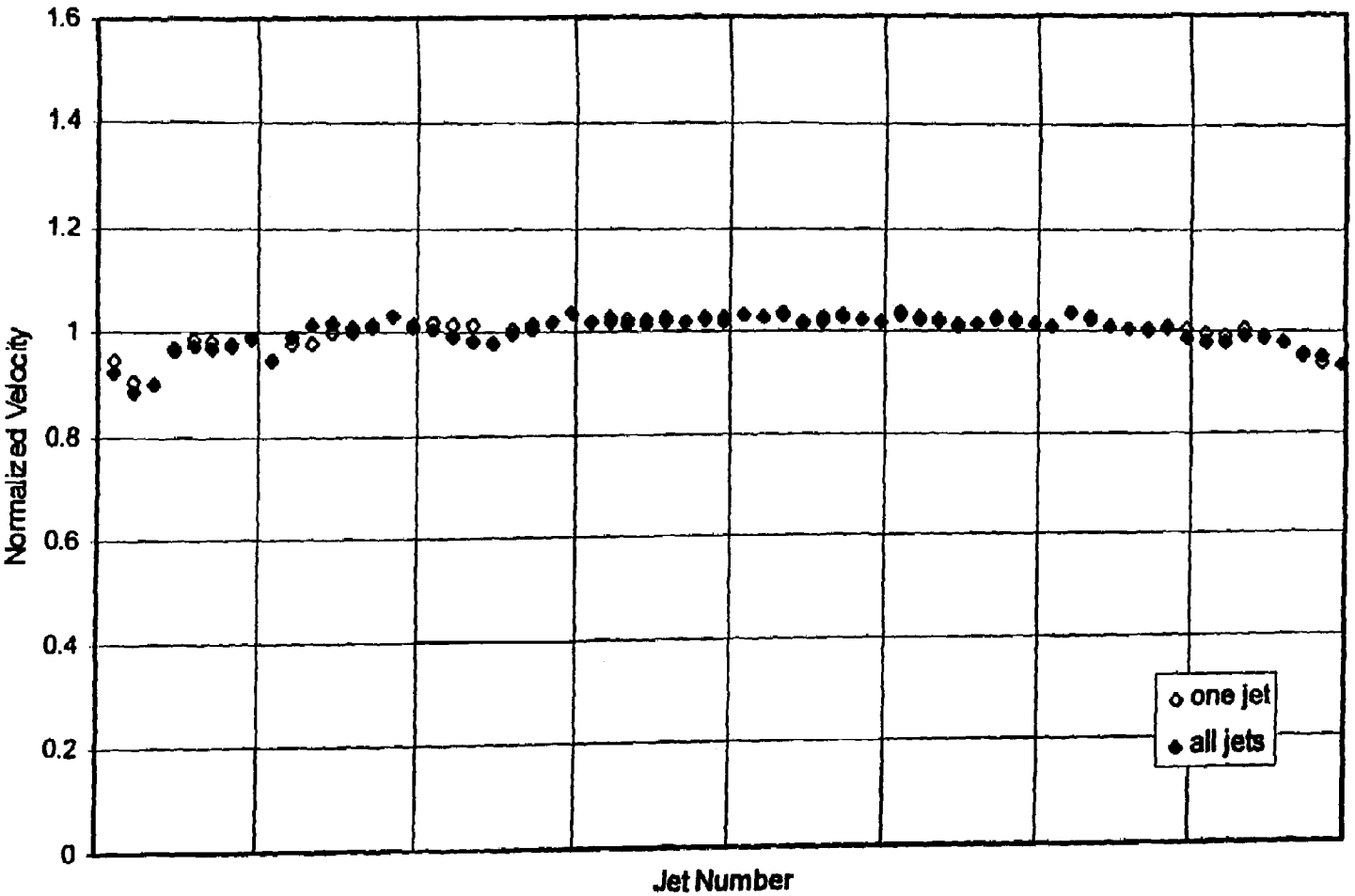
FIG. 6 is a graph of jet velocity data for a 256 jet embodiment of the print head.

Referring to FIG. 6, velocity data is shown for a 256 jet print head of the design in FIG. 5. The velocity data is presented normalized to the average velocity of all the jets. Two sets of data are overlaid on the graph. One set is the velocity of a given jet measured when no other jets are firing. The other set of data is the velocity of a given jet when all other jets are firing. The two sets of data almost completely overlaying one another is an indication of the low crosstalk between jets that this configuration provides.

OTHER EMBODIMENTS

In another embodiment, the piezoelectric elements 34, 34' do not have electrodes on their surfaces. The flex prints 30, 30' have electrodes that are brought into sufficient contact with the piezoelectric element and are of a shape such that electrodes on the piezoelectric material are not required. This is discussed in U.S. Pat. No. 5,755,909, the entire content of which is incorporated herein by reference.

In another embodiment, the piezoelectric elements 34, 34' have electrodes only on the surface away from the pumping chambers.

In another embodiment, the piezoelectric elements shave drive and common electrodes on the surface away from the pumping chambers, and a common electrode on the side next to the pumping chambers. This electrode configuration is more efficient (more piezoelectric element deflection for a given applied voltage) than having electrodes only on the surface of the piezoelectric element away from the pumping chambers.

This configuration results in some electric field lines going from one surface of the piezoelectric element to the other surface, and hence having a component parallel to the poling field in the piezoelectric element. The component of the electric field parallel to the poling field results in extension mode deflection of the piezoelectric element. With this electrode configuration, the extension mode deflection of the piezoelectric element causes stress in the plane of the piezoelectric element. Stress in the plane of the piezoelectric element caused by one jet can adversely affect the output of other jets. This adverse effect varies with the number of jets active at a given time, and varies with the frequency that the jets are activated. This is a form of crosstalk. In this embodiment, efficiency is traded for crosstalk.

In the embodiment with electrodes on the surface of the piezoelectric element adjacent to the pumping chambers, no efficiency is gained from adding a ground electrode on the surface of the piezoelectric element away from the pumping chambers. Adding a ground electrode to the surface of the piezoelectric element away from the pumping chamber will increase the electrical capacitance of the jet and so will increase the electrical drive requirements.

In another embodiment, the piezoelectric elements 34, 34' have drive and common electrodes on both surfaces.

Still other embodiments are within the scope of the following claims. For example, the flex print may be made of a wide variety of flexible insulative materials, and the dimensions of the flex print may be any dimensions that will achieve the appropriate degrees of compliance adjacent the ink reservoirs and adjacent the fill passage. In regions where the flex print seals only the fill passage and is not required to provide electrical contact, the flex print could be replaced by a compliant metal layer.

What is claimed is:

1. A method of making a piezoelectric ink jet module, comprising:

placing an electrical connection only on one side of a piezoelectric element; and positioning the piezoelectric element relative to a reservoir to subject fluid within the reservoir to jetting pressure, wherein the side of the piezoelectric element having the electrical connection is adjacent the reservoir.

2. The method of claim 1 further comprising sizing the piezoelectric element to cover the reservoir without covering a flow path to the reservoir.

3. The method of claim 1 further comprising forming a plurality of reservoirs in the module.

4. The method of claim 3 further comprising covering the plurality of reservoirs wit a singe piezoelectric element.

5. The method of claim 3 further comprising covering the plurality of reservoirs with separate respective piezoelectric elements.

6. The method of claim 3 wherein the piezoelectric element comprises a monolithic piezoelectric member.

7. The method of claim 1 wherein the electrical connection is disposed on a flexible material.

8. The method of claim 7 wherein the flexible material comprises a polymer.

9. The method of claim 1 wherein the piezoelectric element comprises a shear mode piezoelectric element.

10. A method of making a piezoelectric ink jet module, comprising:

positioning a piezoelectric element to subject fluid within a reservoir to jetting pressure, where the piezoelectric ink jet module includes a flow path to the reservoir;

positioning a first electrically insulating flexible material between the reservoir and the piezoelectric element in a manner tat seals the reservoir, where the flexible material carries an electrical contact configured to activate the piezoelectric element; and positioning a flexible element in a manner to form a flexible wall of the flow path.

11. The method of claim 10 wherein the first electrically insulating flexible material comprises a polymer.

12. The method of claim 10 wherein the flexible element comprises a second electrically insulating flexible material.

13. The method of claim 12 wherein the first and second electrically insulating flexible materials are the same.

14. The method of claim 12 wherein the second electrically insulating flexible material comprises a polymer.

15. The method of claim 10 further comprising forming a plurality of reservoirs in the module.

16. The method of claim 15 further comprising covering the plurality of reservoirs with a single piezoelectric element.

17. The method of claim 15 further comprising covering the plurality of reservoirs with separate respective piezoelectric elements.

18. The method of claim 10 wherein the piezoelectric element comprises a shear mode piezoelectric element.

* * * * *

UNITED STATES PATENT AND TRADEMARK OFFICE

CERTIFICATE OF CORRECTION

PATENT NO. : 7,478,899 B2
APPLICATION NO. : 11/336423
DATED : January 20, 2009
INVENTOR(S) : Edward R. Moynihan It is certified that error appears in the above-identified patent and that said Letters Patent is hereby corrected as shown below:

Column 7, line 16, Claim 4, replace;

"wit a singe" with
-- with a single --

Column 8, line 6, Claim 10, replace;

"tat" with
-- that --

Signed and Sealed this

Seventh Day of April, 2009

JOHN DOLL
*Acting Director of the United States Patent and Trademark Office*